United States Patent [19]

Schimko

[11] Patent Number: 4,583,380

[45] Date of Patent: Apr. 22, 1986

[54] CARRIAGE REMOVAL AND SUPPORTING DEVICE FOR FLAT KNITTING MACHINES

[75] Inventor: Reinhold Schimko, Aalen-Wasseralfingen, Fed. Rep. of Germany

[73] Assignee: Universal Maschinenfabrik Dr. Rudolf Schieber GmbH & Co. KG, Fed. Rep. of Germany

[21] Appl. No.: 765,484

[22] Filed: Aug. 14, 1985

[30] Foreign Application Priority Data

Aug. 14, 1984 [DE] Fed. Rep. of Germany ..... 3429931

[51] Int. Cl.[4] ..... D04B 7/04

[52] U.S. Cl. ..... 66/64

[58] Field of Search ..... 66/64, 60, 78

[56] References Cited

U.S. PATENT DOCUMENTS 1,210,106 12/1916 Schwartz et al. ..... 66/64

*Primary Examiner*—Ronald Feldbaum

*Attorney, Agent, or Firm*—Sughrue, Mion, Zinn, Macpeak and Seas

[57] ABSTRACT

An apparatus for removing the carriage (1) from the frame (2) of a flat knitting machine and holding it in any desired pivoted position includes, for simple and rapid removal, positioning for control and repair operations and the movement of even large and heavy carriages (1)

a bearing member (3) of the longitudinal axis (S) through the center of gravity of the cross-section of the carriage, a support tube (5) securable at one end in the bearing member (3) so that it extends approximately along the longitudinal axis (S) through the center of gravity of the carriage cross-section, a supporting frame (6) on the other end of the support tube (5) and supporting and clamping means (7,8,9,10) securable to both ends of the carriage (1) and slidingly engaging the support tube (5).

8 Claims, 2 Drawing Figures

CARRIAGE REMOVAL AND SUPPORTING DEVICE FOR FLAT KNITTING MACHINES

Figure 1:
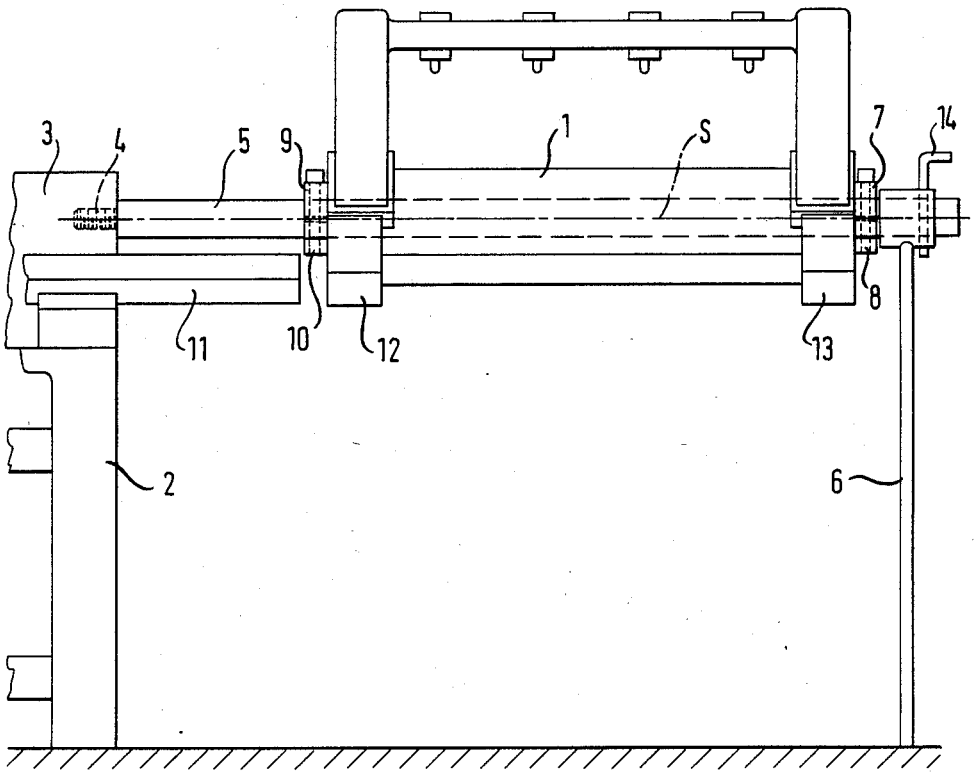

The invention relates to an apparatus for removing the carriage from the frame of a flat knitting machine and holding it in any desired pivoted positions.

In order to be able to carry out repairs on the carriage or on the latches of a flat knitting machine, both the carriage and also its latches must be easily accessible for the repair work. With a carriage of small weight, this can be raised from the frame by one or two people and then laid on a prepared work bench, where it can then be likewise turned into positions in which the parts to be repaired are readily accessible. Problems always arise however, when dealing with large carriages of high weight. To solve these problems, carriages of high weight have previously been constructed so that they are easily displaceable on the frame. Either the carriage strap or straps, which connect together the front and rear carriage cam-boxes with the associated latches, could be removed, so that the front or the rear carriage cam-box could then be separately removed from the frame, or the carriage was constructed so that is comprised a self-supporting unit and so that the latch casings could be separately removed or displaced. In compact constructions, in which several latches, for example four latching systems, are mounted side-by-side in the carriage, dismantling of the carriage in this way has never appeared to be desirable, however.

The invention is based upon the problem of constructing an apparatus of the kind mentioned at the beginning, which enables simple removal of any carriage from the frame of a flat bed knitting machine and easy and rapid repair of this carriage.

This object is solved with an apparatus of the kind mentioned at the beginning which, in accordance with the invention, includes:

(a) a bearing member on at least one end of the frame in the region of the longitudinal axis through the centre of gravity of the cross-section of the carriage, (b) a support tube attachable at one end to the bearing member so that it runs approximately along the longitudinal axis through the centre of gravity of the cross-section of the carriage, (c) a supporting frame at the other end of the support tube, and (d) supporting and clamping means slidingly engaging the support tube and securable to both ends of the carriage.

With this apparatus, the carriage can be drawn from the frame on to the support tube by a person carrying out repairs, with little expenditure of time and force, easily turned on the support tube into the pivoted position most suitable for the repair work and fixed in this pivoted position by carrying out the appropriate mounting operations. After completing the repairs, the carriage can similarly be easily and rapidly returned to the frame. A separate repair bench is no longer required.

The supporting frame is advantageously a bipod attachable, for example slidable, on to the supporting tube and fixedly connectible with it.

Preferably, the supporting and clamping means comprise clamping rings, each having two clamping members, one clamping member at each end of the carriage being fixedly connectible with it.

Advantageously, the support tube, which is preferably a steel tube, can be screwed into the bearing member. This gives a particularly simple and easy location of the apparatus according to the invention, for its use and removal following the completion of repairs.

Advantageously, the supporting and clamping means are readily detachable from the carriage, for instance by means of screws. Thus, the supporting and clamping means can be detached from the carriage before it is returned for use and so do not contribute to any increase in the weight and mass of the carriage when in operation.

The flat bed knitting machine advantageously includes carriage guide rails which extend from at least one end of the machine frame, on which the carriage is guided on to the supporting tube, in order to take over the carriage supporting function, by one of the supporting and clamping means.

It is advantageous if the bearing member is movable by at least the width of the carriage guides and relative to the ends of the carriage guide rails to the middle of the frame, as this ensures that the taking over of the supporting and guiding function for the carriage by the supporting and clamping means on the support tube is effected before the carriage guides run off from the carriage guide rails.

Figure 2:
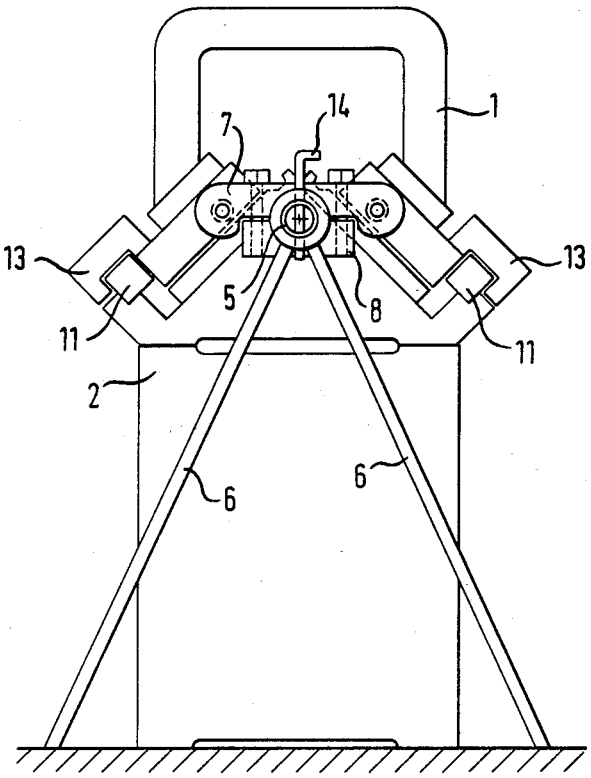

An embodiment of the invention is illustrated in the drawings and is described further below:

In the drawings, there are shown:

FIG. 1: a diagrammatic side view of a preferred embodiment of the carriage removal and holding device, according to the invention, with the carriage raised, and FIG. 2: a diagrammatic end view of the apparatus according to FIG. 1.

The apparatus shown in the drawings for removing a carriage 1 from the frame 2 includes a support tube 5, in the form of a steel tube, which can be screwed at one end into a bearing member 3 on an end of the frame 2 by means of a screw 4, a supporting frame 6 in the form of a bipod at the other end of the support tube 5 and supporting and clamping means 7,8 and 9,10, slidingly engaging the support tube 5 and securable to both ends of the carriage 1. The supporting and clamping means consist of clamping rings, each having two clamping members 7 and 8, 9 and 10, the clamping members 7 and 9 of which are screwed on to the carriage 1.

When the carriage 1 is to be removed from the frame, the support tube 5 is screwed into the bearing member 3 at the end of the frame 2, so that it is located centrally and parallel to the carriage guide rails 11, and at the other end it is stabilised by the supporting frame 6 exactly at the height of and parallel to the carriage guide rails 11. The guide rails 11 are so long that when the carriage 1 is at the right-hand end of the guide rails, the right-hand end of the carriage 1 stands in the region of the support tube 5. In this position at the right-hand end of the carriage 1, the clamping rings 7,8 forming the right-hand supporting and clamping means and consisting of the two clamping members 7 and 8 are screwed into place, being fixedly connected to the carriage 1, on the one hand, and, on the other hand, slidingly engaging the support tube 5, so that, on further sliding of the carriage 1 towards the right, until its left-hand guides 12 are located at the ends of the carriage guide rails 11, the right-hand carriage guides 13 slide from the carriage guide rails 11 and the right-hand clamping members 7,8 take over the guidance and support function. In this position of the carriage, an abutment in the form of a detent is provided in the support tube 5. This serves as a safety device. It can happen that the carriage is moved too far to the right, with the left-hand guide portions 12 sliding from the carriage guide rails 11 before the clamping rings 9,10 are secured to the carriage. Then, at the left-hand end of the carriage 1, a supporting and clamping means in the form of the clamping ring 9,10 consisting of clamping members 9 and 10, which likewise engage the support tube 5, are screwed into place. On further travel to the right the carriage 1 then slides with its left-hand carriage guides 12 from the carriage guide rails 11, so that the entire guidance and support of the carriage 1 is taken over by the clamping rings 7,8 and 9,10 on the support tube 5. It is important that the support tube 5 stands in the longitudinal axis S of the centre gravity of the cross-section through the carriage.

The carriage 1, which is now guided only on the support tube 5, is thus in a neutral state of equilibrium and so cannot tilt to either side, either forwardly or rearwardly; it can nevertheless be turned easily by hand into the position which is the area for inspection relevant to the control and repair work required, in which for example the forward or the rear latch is available for inspection. On securing the clamping members 7,8 and 9,10, the carriage can be fixed in a simple way in the position which it has assumed, whereupon the corresponding assembly operations can be carried out.

A guide pin 14 connects the support tube 5 non-rotationally with the supporting frame 6 and prevents release of the support tube 5 from the bearing member 3 or the screw 4.

When the carriage 1 is to be shifted back on to the frame 2, on completing the repair work, the clamping members 7,8 and 9,10 are released, the carriage 1 is turned into the operative position, in which the left-hand carriage guides 12 stand over the carriage guide rails 11, the carriage 1 is then fitted on to the ends of the carriage guide rails 11 and then finally is slid to the left. Then in the reverse sequence, all the above-mentioned operative steps are carried out, that is the clamping members 9,10 and 7,8 are released from the carriage 1 and the support tube 5 is released from the bearing member 3 or the frame 2 itself together with the supporting frame 6.

I claim:

1. An apparatus for removing the carriage from the frame of a flat knitting machine and holding it in any desired pivoted position comprising, (a) a bearing member on at least one end of the frame in the region of the longitudinal axis through the centre of gravity of the cross-section of the carriage, (b) a support tube attachable at one end to the bearing member so that it runs approximately along the longitudinal axis through the centre of gravity of the cross-section of the carriage, (c) a supporting frame at the other end of the support tube, and (d) supporting and clamping means slidingly engaging the support tube and securable to both ends of the carriage.

2. An apparatus according to claim 1, wherein the supporting frame is a bipod attachable to the support tube and fixedly connectable to it.

3. An apparatus according to claim 1, wherein the supporting and clamping means comprise clamping rings each having two clamping members, one clamping member at each end of the carriage being fixedly connectible with it.

4. An apparatus according to claim 1, wherein the support tube can be screwed into the bearing member.

5. An apparatus according to claim 1, wherein the support tube is a steel tube.

6. An apparatus according to claim 1, wherein the supporting and clamping means are readily detachably connected to the carriage.

7. An apparatus according to claim 1, wherein the flat bed knitting machine includes carriage guide rails which extend from at least one end of the frame.

8. An apparatus according to claim 1, wherein the bearing member is moved to the middle of the frame, relative to the ends of the carriage guide rails, by at least the width of the carriage guides.

* * * * *